US010598190B2

(12) United States Patent
Kim et al.

(10) Patent No.: US 10,598,190 B2
(45) Date of Patent: Mar. 24, 2020

(54) CENTRIFUGAL BLOWER

(71) Applicant: COWAY CO., LTD, Chungcheongnam-do (KR)

(72) Inventors: Sung-Jin Kim, Seoul (KR); Sang-Gu Sim, Seoul (KR); Myung-Jin Park, Seoul (KR); Bong-Suk Kim, Seoul (KR); Chan-Jung Park, Seoul (KR)

(73) Assignee: COWAY CO., LTD., Chungcheongnam-do (KR)

( * ) Notice: Subject to any disclaimer, the term of this patent is extended or adjusted under 35 U.S.C. 154(b) by 250 days.

(21) Appl. No.: 15/508,203

(22) PCT Filed: Sep. 2, 2015

(86) PCT No.: PCT/KR2015/009211
§ 371 (c)(1),
(2) Date: Mar. 2, 2017

(87) PCT Pub. No.: WO2016/036119
PCT Pub. Date: Mar. 10, 2016

(65) Prior Publication Data

US 2017/0284413 A1 Oct. 5, 2017

(30) Foreign Application Priority Data

Sep. 3, 2014 (KR) ..... 10-2014-0117064
Aug. 31, 2015 (KR) ..... 10-2015-0122827

(51) Int. Cl.
*F04D 29/44* (2006.01)
*F04D 17/16* (2006.01)
(Continued)

(52) U.S. Cl.
CPC ..... *F04D 29/444* (2013.01); *F04D 17/162* (2013.01); *F04D 29/424* (2013.01);
(Continued)

(58) Field of Classification Search
CPC ..... F04D 17/162; F04D 25/06; F04D 25/08; F04D 29/40; F04D 29/403; F04D 29/42;
(Continued)

(56) References Cited

U.S. PATENT DOCUMENTS

2007/0128019 A1* 6/2007 Chao ..... F04D 29/4226 415/204
2009/0145583 A1* 6/2009 Han ..... F04D 29/282 165/121

FOREIGN PATENT DOCUMENTS

CN 203641114 6/2014
CN 203641114 U * 6/2014
(Continued)

OTHER PUBLICATIONS

International Search Report, PCT/KR2015/009211, dated Nov. 30, 2015, 4 pages.

*Primary Examiner* — Patrick Hamo
*Assistant Examiner* — Chirag Jariwala
(74) *Attorney, Agent, or Firm* — Dority & Manning, P.A.

(57) ABSTRACT

A disclosed centrifugal blower comprises: a centrifugal fan; a scroll casing which is configured so as to surround the centrifugal fan, has an air inlet on at least one surface thereof, has an air outlet on one side thereof, and guides, to the air outlet, air discharged from the centrifugal fan; an expansion part which is provided at the air outlet and is configured such that the cross-sectional area of the flow path is expanded in the air discharge direction; and a dividing plate which is provided in the expansion part, is arranged at the outside of the air outlet and is arranged lengthwise along the flow direction of the air discharged from the air outlet.

7 Claims, 6 Drawing Sheets

(51) Int. Cl.
*F04D 29/42* (2006.01)
*F04D 29/66* (2006.01)
*F04D 29/70* (2006.01)

(52) U.S. Cl.
CPC ..... *F04D 29/441* (2013.01); *F04D 29/663* (2013.01); *F04D 29/703* (2013.01)

(58) Field of Classification Search
CPC ..... F04D 29/4206; F04D 29/422; F04D 29/4226; F04D 29/424; F04D 29/44; F04D 29/441; F04D 29/444; F04D 29/66; F04D 29/661; F04D 29/663; F04D 29/664; F04D 29/667; F04D 29/668; F04D 29/70; F04D 29/701; F04D 29/703
See application file for complete search history.

(56) References Cited

FOREIGN PATENT DOCUMENTS

| | | | | |
|---|---|---|---|---|
| JP | 6-173899 | | | 6/1994 |
| KR | 20060089125 | A | * | 8/2006 |
| KR | 0657528 | | | 12/2006 |
| KR | 2009-0059234 | | | 6/2009 |
| KR | 2012-0054917 | | | 5/2012 |
| KR | 1140708 | | | 7/2012 |

* cited by examiner

[Figure 1]
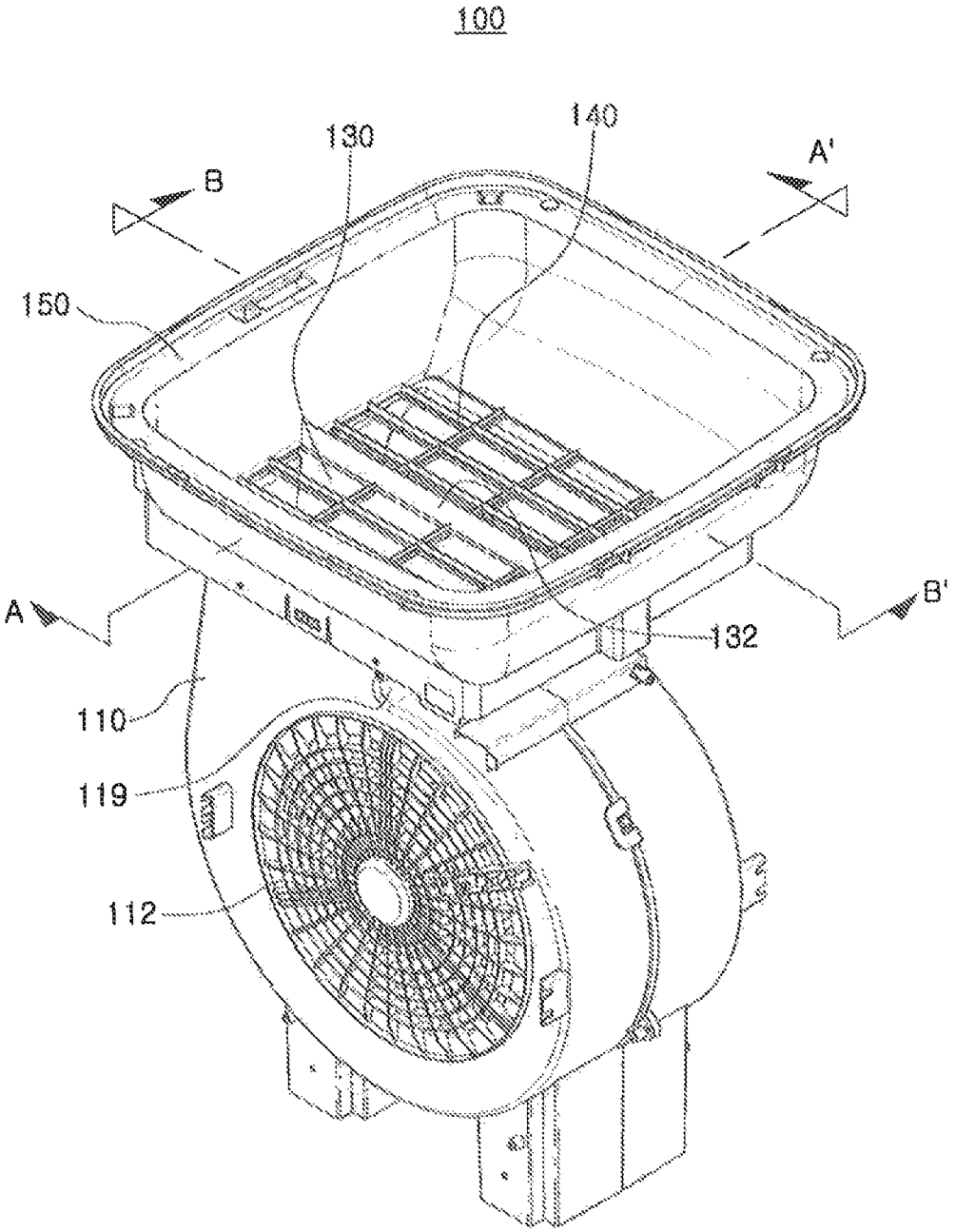

【Figure 2】
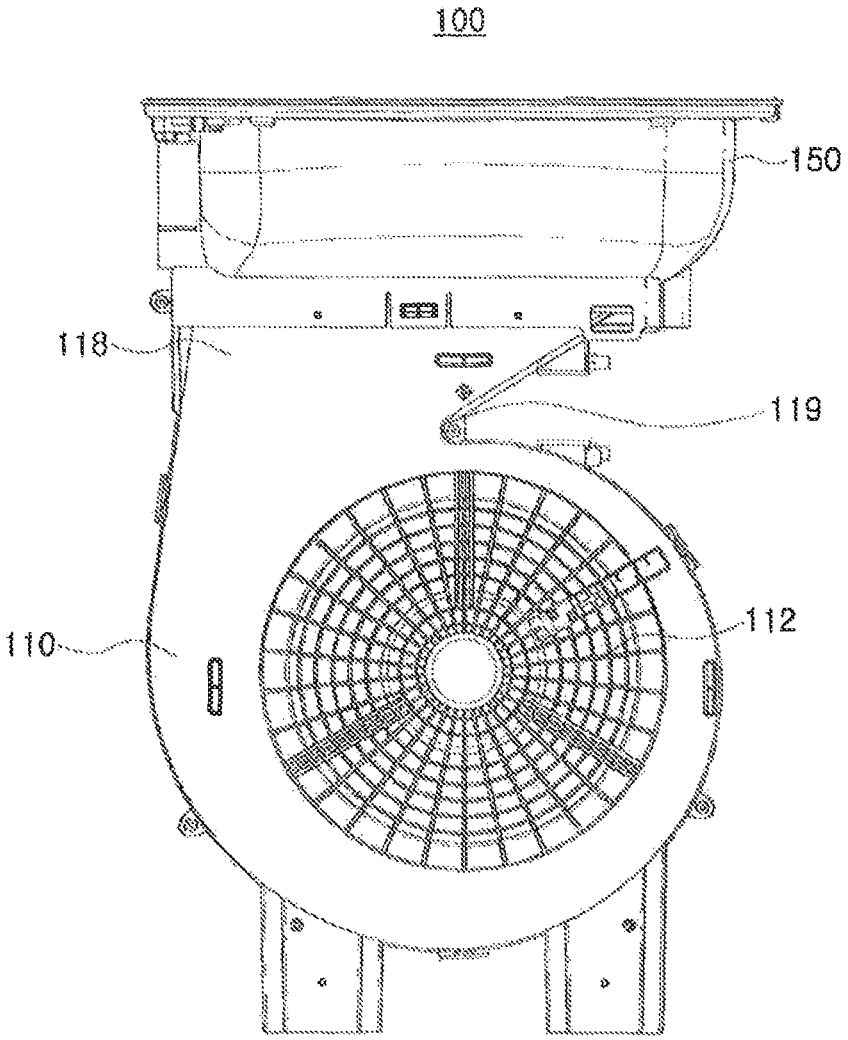

【Figure 3】
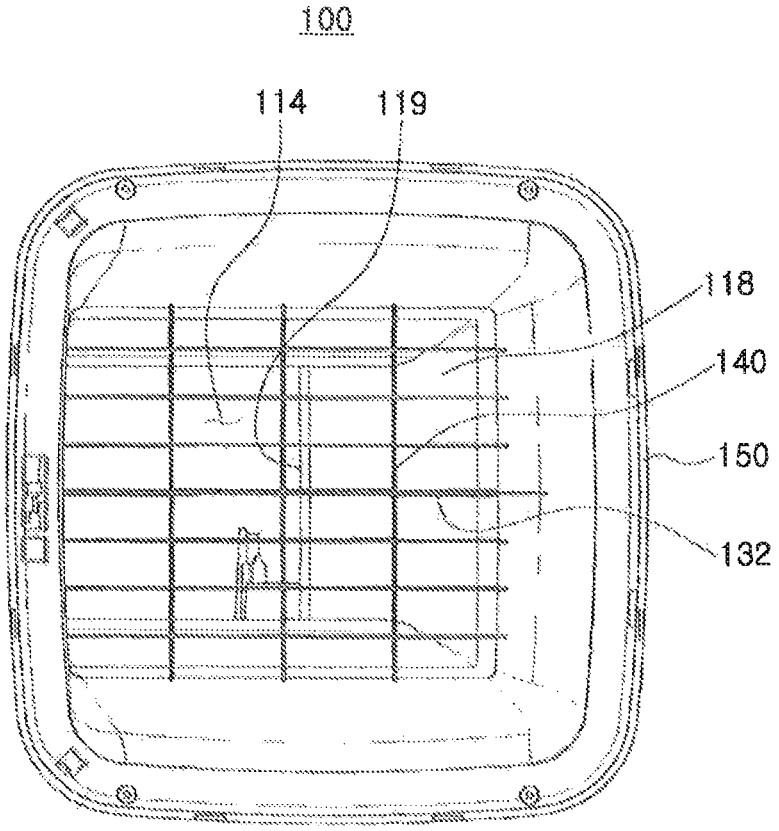

【Figure 4】
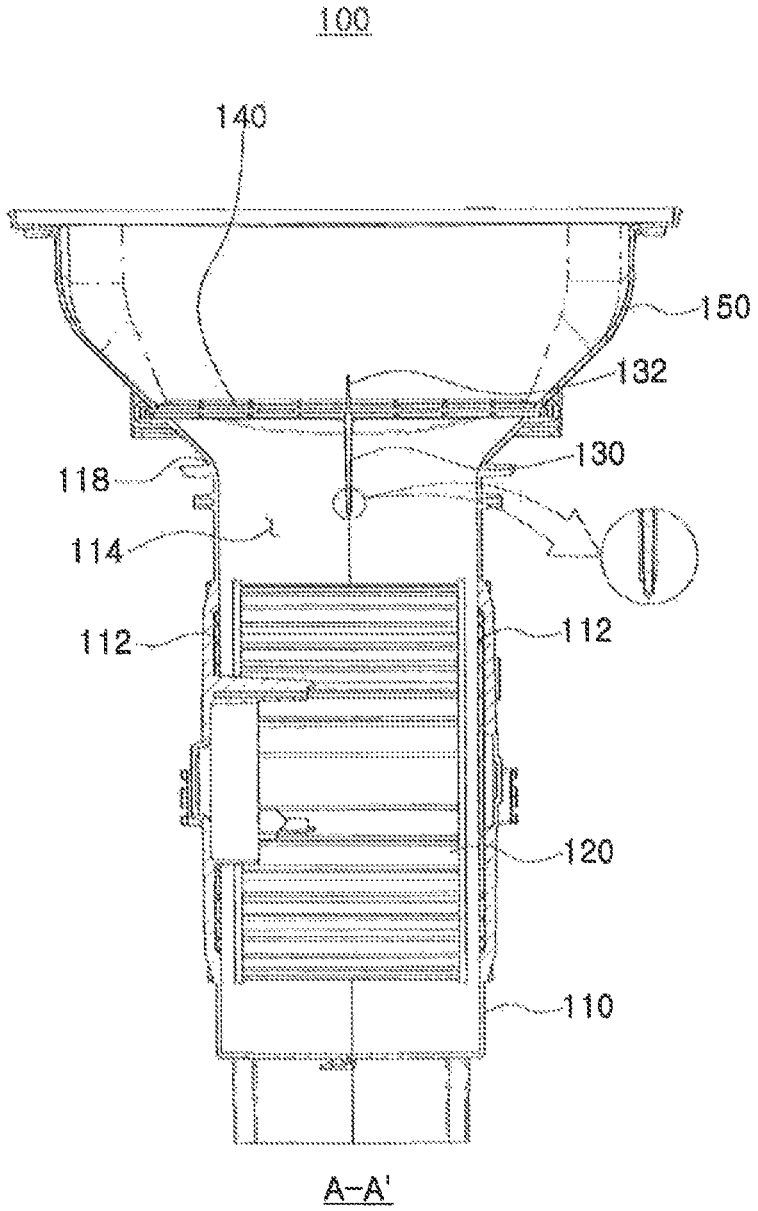

【Figure 5】
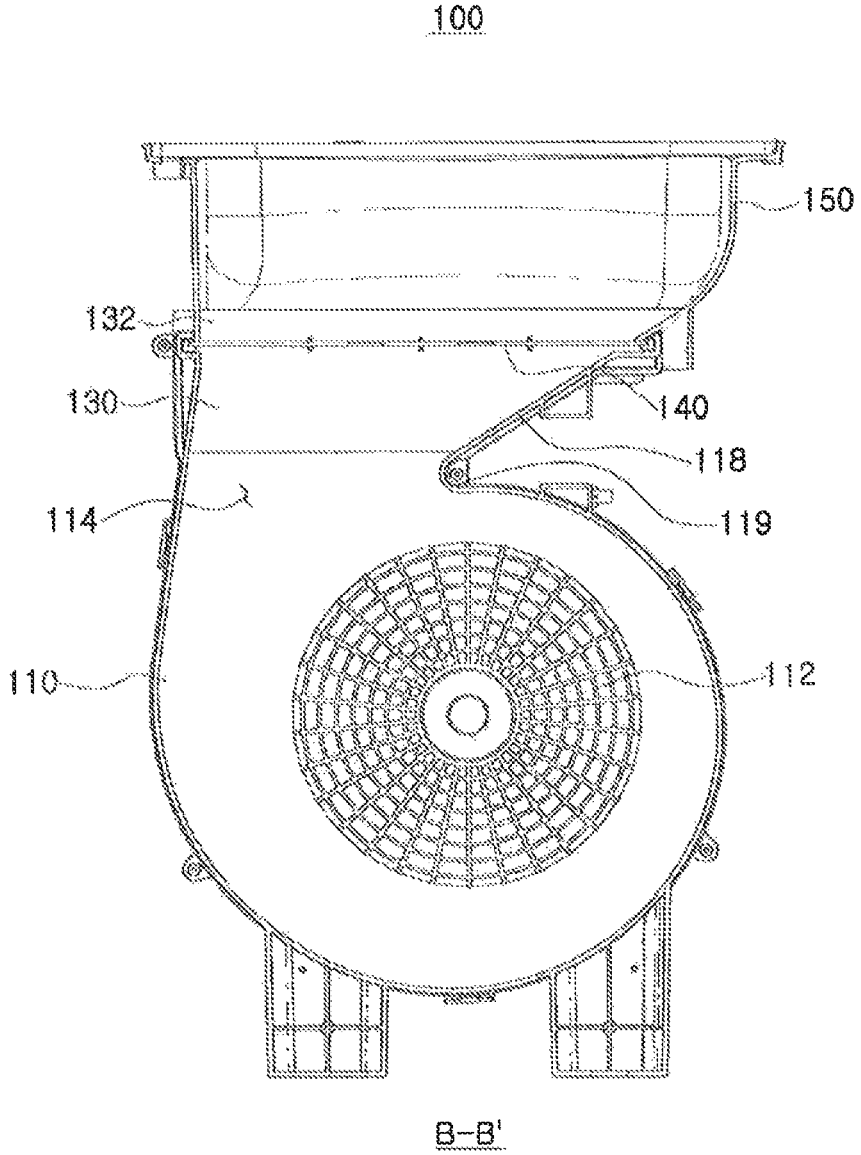

【Figure 6】
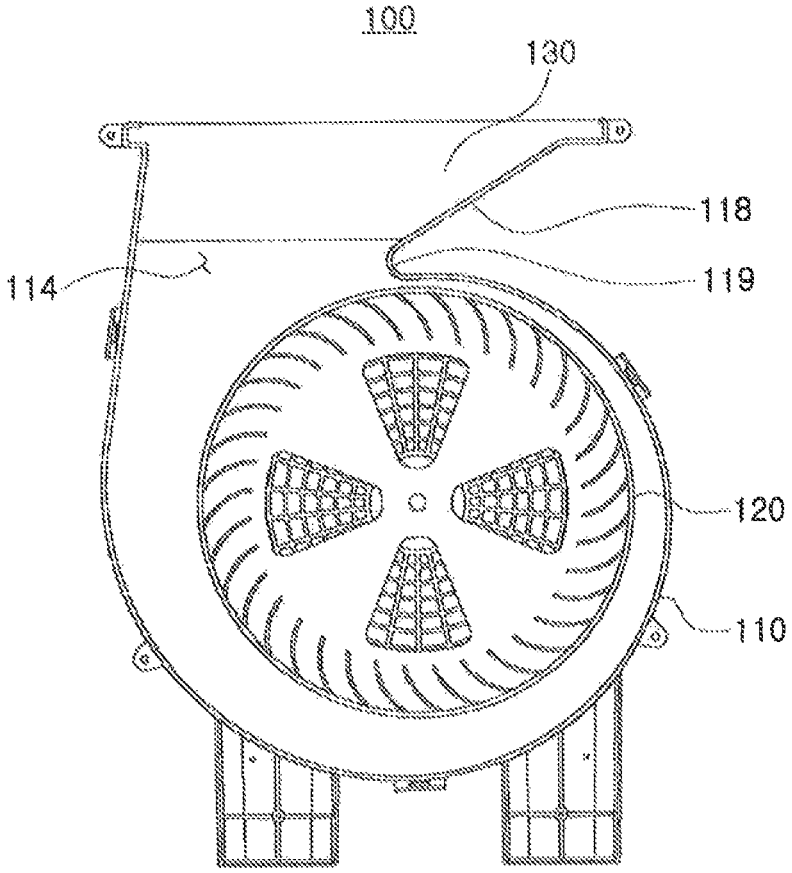

CENTRIFUGAL BLOWER

TECHNICAL FIELD

The present disclosure relates to a centrifugal blower, and more specifically, to a centrifugal blower that may reduce an imbalance in a flow of discharged air and noise.

BACKGROUND ART

In general, blowers are used in air cleaners, fans, and the like, and used industrially in air conditioner systems, various types of air intake and exhaust systems, and the like. Blowers can be classified as axial flow blowers, centrifugal blowers, or mixed flow blowers, depending on the characteristics of flow passing through the impellers thereof.

Among the above-mentioned blowers, centrifugal blowers allow the flow of air to occur, such that intake flow is generated in a direction of an axis of rotation thereof and exhaust flow is generated in a direction perpendicular to the axis of rotation, and is applied to common household air cleaners.

The centrifugal blower has a single-side intake method, in which intake flow is generated from one side of the axis of rotation, and a dual-side intake method, in which intake flow is generated from both sides of the axis of rotation.

Generally, such a centrifugal blower includes a centrifugal fan having a plurality of wings disposed in a circumferential direction thereof, and a scroll casing configured to surround the centrifugal fan while having an outlet guiding, to one side of the scroll casing, air discharged in the circumferential direction of the centrifugal fan.

However, a centrifugal blower, according to the related art, has a problem in that noise by air friction is generated and air volume is reduced, due to the imbalance of flow discharged from the outlet of the scroll casing.

In particular, the end of the outlet of the scroll casing is expanded, allowing for an increase in an opening area thereof, in order to diffuse air, and due to an expansion effect, the imbalance of exhaust flow is significantly generated.

DISCLOSURE

Technical Problem

An aspect of the present disclosure may provide a centrifugal blower having stable exhaust flow.

Technical Solution

According to an aspect of the present disclosure, a centrifugal blower may include: a centrifugal fan; a scroll casing configured to surround the centrifugal fan, having an air inlet in at least one surface thereof, having an air outlet in one side thereof, and guiding, to the air outlet, air discharged from the centrifugal fan; an expansion part provided at the air outlet and configured such that the cross-sectional area of a flow path is expanded in an air discharge direction; and a dividing plate provided in the expansion part, arranged on the outside of the air outlet, and arranged lengthwise in a flow direction of air discharged from the air outlet. The scroll casing may have a cutoff portion formed on one side of the air outlet, and the dividing plate may be provided on the outside of the scroll casing, based on the cutoff portion.

The dividing plate may divide the flow path inside the expansion part into two flow paths.

The dividing plate may be disposed parallel to both surfaces of the scroll casing, and may also be disposed perpendicular to both surfaces of the scroll casing.

The dividing plate may be tapered such that the width thereof narrows toward an internal end thereof disposed on a side of the centrifugal fan.

The centrifugal fan may be configured to intake air from both sides thereof, and the scroll casing may have the air inlet provided in each of both surfaces thereof.

The centrifugal blower may further include an exhaust grill mounted on an outlet of the expansion part.

The dividing plate may be coupled to the exhaust grill.

The dividing plate may have a protruding portion protruding externally from the exhaust grill.

The centrifugal blower may further include a diffuser coupled to an outlet of the expansion part while diffusing air discharged from the expansion part.

Advantageous Effects

According to an embodiment in the present disclosure, the flow of discharged air may be stabilized through a dividing plate provided in an air outlet to solve the imbalance of exhaust flow, thus reducing noise by the imbalance and increasing exhaust air volume.

DESCRIPTION OF DRAWINGS

FIG. 1 is a perspective view of a centrifugal blower according to an embodiment;

FIG. 2 is a side view of the centrifugal blower illustrated in FIG. 1;

FIG. 3 is a plan view of the centrifugal blower illustrated in FIG. 1;

FIG. 4 is a cross-sectional view of the centrifugal blower illustrated in FIG. 1, taken along line A-A';

FIG. 5 is a cross-sectional view of the centrifugal blower illustrated in FIG. 1, taken along line B-B'; and FIG. 6 is a cross-sectional view of the centrifugal blower illustrated in FIG. 1 in a state in which an exhaust grill and a diffuser are removed therefrom.

BEST MODE FOR INVENTION

The terminology used herein is for the purpose of describing particular embodiments only, and is not intended to limit the present disclosure. In addition, the singular forms "a," "an," and "the" are intended to include the plural forms as well, unless the context clearly indicates otherwise.

Hereinafter, the exemplary embodiments of the present disclosure will be described in detail with reference to the attached drawings.

Referring to FIGS. 1 to 6, a centrifugal blower according to an embodiment will be described.

As illustrated in FIGS. 1 through 6, a centrifugal blower 100 according to an embodiment may include a scroll casing 110, a centrifugal fan 120, and a dividing plate 130, and may further include an exhaust grill 140 provided at an expansion part 118 of the scroll casing 110, and a diffuser 150 provided on an outlet of the expansion part 118.

The scroll casing 110 may be configured to surround the centrifugal fan 120 to be described later in a circumferential direction of the centrifugal fan 120, thereby guiding air discharged in the circumferential direction.

The scroll casing 110 may have an air inlet 112 provided in at least one surface thereof, and may have an air outlet 114 provided in one side thereof in the circumferential direction of the centrifugal fan 120.

As an example, the scroll casing 110 may have air inlets 112 provided in both surfaces thereof corresponding to the point at which the centrifugal fan 120 to be described later is of a dual-side intake type.

In such a configuration, air discharged in the circumferential direction of the centrifugal fan 120 may be guided along an inner wall of the scroll casing 110 to be discharged externally through the air outlet 114.

In an embodiment, the air outlet 114 of the scroll casing 110 may have the expansion part 118 formed thereat, such that the cross section of a flow path is gradually increased in an air discharge direction.

The expansion part 118 may have the advantage of allowing air discharged from the air outlet 114 to be discharged in a wide area, and reducing negative pressure generated on the discharged air, even when a discharge flow rate is increased, through a structure in which the flow path is expanded.

Meanwhile, the air outlet 114 may have a cutoff portion 119 formed on one side thereof.

The cutoff portion 119 may be a concave part formed on a joint portion between the scroll casing 110 and the expansion part 118.

The centrifugal fan 120 may be provided inside the scroll casing 110, and may intake air in a direction of an axis of rotation of the centrifugal fan 120 and discharge the air in the circumferential direction. The centrifugal fan 120 is not particularly limited, and may be configured as various types of centrifugal fans of the related art.

In an embodiment, the centrifugal fan 120 may be configured as a dual-side intake type fan capable of intaking air from both sides thereof. Because the centrifugal fan 120 of the dual-side intake type fan allows for a large air intake amount, as compared to a single intake type, air volume of the centrifugal blower 100 may be increased.

The dividing plate 130 may be provided in the expansion part 118, and may be formed to extend lengthwise in a flow direction of air discharged from the air outlet 114, thereby guiding the air.

The dividing plate 130 may be provided in the expansion part 118, and may be disposed on the outside of the air outlet 114. In other words, the dividing plate 130 is provided on the outside of the scroll casing 110, based on the cutoff portion 119.

In this structure, the dividing plate 130 may be disposed on the outside of the scroll casing 110 to thus have no influence on an internal volume of the scroll casing 110.

For reference, a structure, in which the dividing plate 130 is provided inside the scroll casing 110, may cause a space, occupied by the dividing plate 130, to reduce the internal volume of the scroll casing 110, and the air volume of the centrifugal blower 100 may be reduced.

The dividing plate 130 may be formed to extend from one side of an inner wall of the expansion part 118 to the other side to divide the flow path inside the expansion part 118 into two flow paths. In an embodiment, the dividing plate 130 may also be disposed on a center of the centrifugal fan 120 in a width direction of the centrifugal fan 120, as illustrated in FIG. 4, but is not limited thereto, and may be disposed in various positions in the width direction of the centrifugal fan 120.

Meanwhile, in an embodiment, the dividing plate 130 may be disposed parallel to both surfaces of the scroll casing 110, as illustrated in FIGS. 1 through 6.

Merely, the dividing plate 130 is not limited thereto, and in another embodiment, the dividing plate 130 may also be disposed perpendicular to both surfaces of the scroll casing 110.

In addition, although not illustrated in the drawings, a plurality of dividing plates 130 may also be disposed parallel to each other at intervals in the expansion part 118, and a dividing plate 130 disposed parallel to both surfaces of the scroll casing 110 and a dividing plate 130 disposed perpendicular to both surfaces of the scroll casing 110 may also be provided in a cross form.

In an embodiment, the dividing plate 130 may also be configured to be tapered, such that the width thereof narrows toward an internal end thereof disposed on a side of the centrifugal fan 120, as illustrated in a partially enlarged view of FIG. 4.

As described above, a structure, in which the internal end of the dividing plate 130 is tapered, may have the advantage of significantly reducing a resistance area thereof for discharged air, thereby significantly reducing noise caused by friction between the dividing plate 130 and the discharged air, and allowing the discharged air to smoothly flow to both surfaces of the dividing plate 130.

The exhaust grill 140 may be configured to be attachable to or detachable from the outlet of the expansion part 118, and as a structure having a grid shape with a plurality of vent holes, may prevent foreign substances from flowing into the scroll casing 110 through the expansion part 118.

In an embodiment, the dividing plate 130 may be coupled to the exhaust grill 140. Here, the dividing plate 130 may also be integrally coupled to the exhaust grill 140, and may also be separably coupled to the exhaust grill 140.

Accordingly, the dividing plate 130 may not require a separate support structure for the expansion part 118, may be supported by the exhaust grill 140, and may be disposed in the expansion part 118.

Meanwhile, in an embodiment, the dividing plate 130 may have a protruding portion 132 protruding externally from the exhaust grill 140, as illustrated in FIGS. 1, 4, and 5.

In an embodiment, the protruding portion 132 may be formed, such that the body of the dividing plate 130 may extend externally from the exhaust grill 140.

The protruding portion 132 may significantly reduce that air flowing on the surface of the dividing plate 130 passes through the exhaust grill 140 and then forms a vortex outside the exhaust grill 140. Accordingly, the flow of discharged air may further be stabilized.

The diffuser 150 may be provided on the outlet of the expansion part 118 as desired.

The diffuser 150 may diffuse air, discharged from the expansion part 118, into a large area of the interior.

The centrifugal blower 100, according to an embodiment as described above, may stabilize the flow of air discharged from the dividing plate 130, provided on the outside of the air outlet 114, to solve the imbalance of exhaust flow, thereby reducing noise by the imbalance and increasing exhaust air volume.

The invention claimed is:

1. A centrifugal blower comprising:

a centrifugal fan;

a scroll casing configured to surround the centrifugal fan, having an air inlet in at least one of a front surface and a rear surface, having an air outlet in one side thereof, and guiding, to the air outlet, air discharged from the centrifugal fan, wherein the scroll casing has a cutoff portion formed on one side of the air outlet;

an expansion part provided at the air outlet and configured such that the cross-sectional area of a flow path is expanded in an air discharge direction;

a dividing plate provided in the expansion part, arranged on the outside of the air outlet, and arranged lengthwise in a flow direction of air discharged from the air outlet; and an exhaust grill configured to be attachable to or detachable from the air outlet of the expansion part, the exhaust grill having a structure of a grid shape with a plurality of vent holes;

wherein the dividing plate is formed to extend from one side of an inner wall of the expansion part to the other side of the inner wall of the expansion part to divide the flow path inside the expansion part into two flow paths, wherein the dividing plate is provided on the outside of the cutoff portion, relative to the cutoff portion, and extends lengthwise in a flow direction of air, starting from outside of the cutoff portion to the exhaust grill, wherein the dividing plate is coupled separably to the exhaust grill, and wherein the dividing plate has a protruding portion protruding externally from the exhaust grill.

2. The centrifugal blower of claim 1, further comprising: a diffuser coupled to an outlet of the expansion part while diffusing air discharged from the expansion part.

3. The centrifugal blower of claim 1, wherein the dividing plate divides the flow path inside the expansion part into two flow paths.

4. The centrifugal blower of claim 1, wherein the dividing plate is disposed parallel to the front surface or the rear surface of the scroll casing.

5. The centrifugal blower of claim 1, wherein the dividing plate is disposed perpendicular to the front surface or the rear surface of the scroll casing.

6. The centrifugal blower of claim 1, wherein the dividing plate is tapered such that the width thereof narrows toward an internal end thereof disposed on a side of the centrifugal fan.

7. The centrifugal blower of claim 1, wherein the centrifugal fan is configured to intake air from both sides thereof, and the scroll casing has the air inlet provided in each of both the front surface and the rear surface thereof.

* * * * *